US008453893B2

(12) United States Patent
Shitaye

(10) Patent No.: US 8,453,893 B2
(45) Date of Patent: Jun. 4, 2013

(54) HYDRATION BELT

(76) Inventor: Tamirat Shitaye, New York, NY (US)

( * ) Notice: Subject to any disclaimer, the term of this patent is extended or adjusted under 35 U.S.C. 154(b) by 468 days.

(21) Appl. No.: 12/501,427

(22) Filed: Jul. 11, 2009

(65) Prior Publication Data

US 2010/0032458 A1 Feb. 11, 2010

Related U.S. Application Data

(63) Continuation-in-part of application No. 10/905,525, filed on Jan. 7, 2005, now abandoned.

(51) Int. Cl.
*A45F 3/00* (2006.01)

(52) U.S. Cl.
USPC ..... 224/148.2; 224/662

(58) Field of Classification Search
USPC ..... 224/148.1, 148.2, 662
See application file for complete search history.

(56) References Cited

U.S. PATENT DOCUMENTS

| | | | | |
|---|---|---|---|---|
| 278,432 | A | 5/1883 | Hoeflich | |
| 790,682 | A | 5/1905 | Friedman | |
| 1,077,800 | A | 11/1913 | Butters | |
| 1,536,965 | A | 5/1925 | Ocker | |
| 1,650,764 | A | 11/1927 | Marin | |
| 2,656,958 | A | 10/1953 | Austin | |
| 2,684,787 | A | 7/1954 | Charpiat | |
| 4,030,646 | A | 6/1977 | Switack | |
| 4,090,650 | A | 5/1978 | Gotta | |
| 4,139,130 | A | 2/1979 | Glusker | |
| 4,176,772 | A | 12/1979 | Danon | |
| 4,265,381 | A | 5/1981 | Muscatell | |
| 4,351,067 | A | 9/1982 | Bartels | |
| 4,526,298 | A | 7/1985 | Boxer | |
| 4,978,021 | A | 12/1990 | Mini | |
| 5,104,016 | A | 4/1992 | Runkel | |
| 5,282,557 | A | 2/1994 | McCook | |
| 5,571,260 | A | 11/1996 | Krug | |
| 5,732,860 | A | 3/1998 | Faraj | |
| 5,984,145 | A | 11/1999 | McAllister | |
| 6,260,731 | B1 | 7/2001 | Cummings | |
| 6,398,092 | B1 * | 6/2002 | Ansley | 224/582 |
| 6,598,770 | B2 | 7/2003 | Bolts | |
| 7,201,299 | B2 * | 4/2007 | Forsman | 224/148.2 |
| 7,464,837 | B2 * | 12/2008 | Hoskins | 222/175 |
| 2003/0075573 | A1 * | 4/2003 | Bailey | 224/148.2 |

* cited by examiner

*Primary Examiner* — Justin Larson
(74) *Attorney, Agent, or Firm* — Jennifer Meredith, Esq.; Meredith & Keyhani, PLLC

(57) ABSTRACT

A wearable hydration belt comprising: a belt; at least one flexible liquid container coupled to the belt, wherein at least one flexible liquid container is substantially flat and belt shaped, the at least one flexible liquid container being more than half the length of the wearable hydration belt; a port located on the liquid container; an extendible drinking tube configured to couple to the port at one end and a spout in communication with a second end of the extendible drinking tube to allow liquid contained in the flexible liquid container to flow through the port, the extendible drinking tube and the spout.

10 Claims, 17 Drawing Sheets

FIG 6
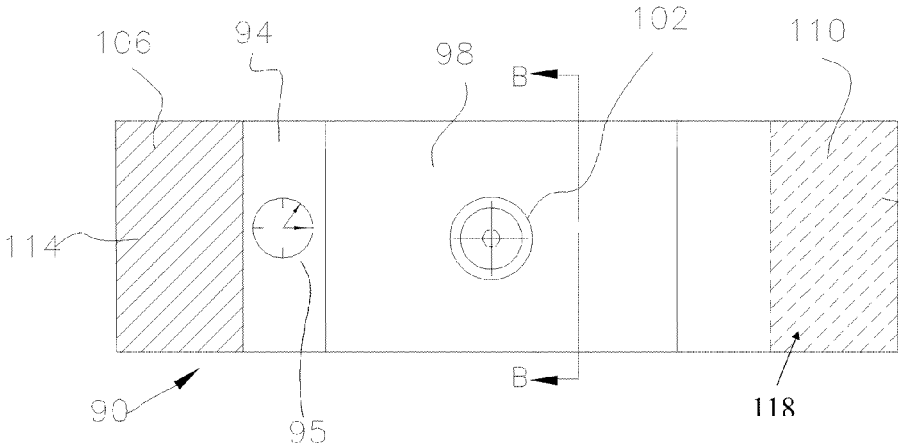
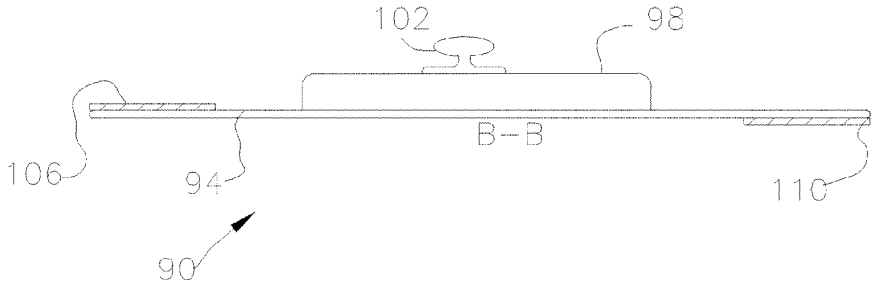
FIG 7

FIGURE 14
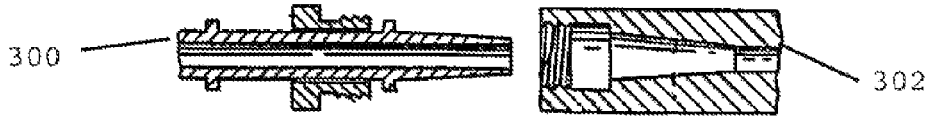
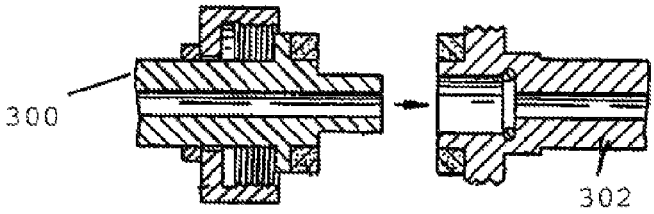
FIGURE 15
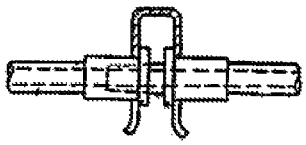
FIGURE 16
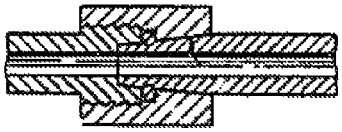
FIGURE 17
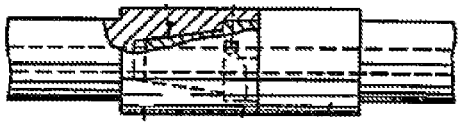
FIGURE 18
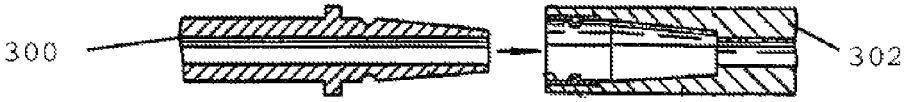
FIGURE 19
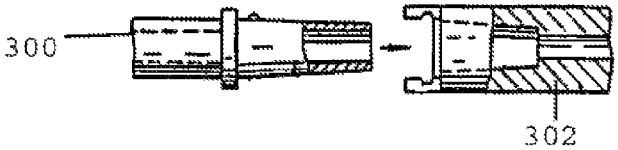
FIGURE 20
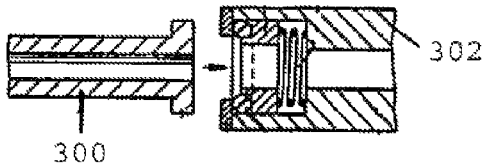
FIGURE 21
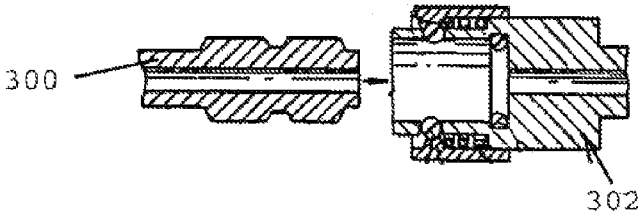
FIGURE 22
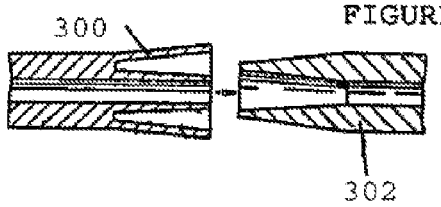
FIGURE 23

HYDRATION BELT

This application claims priority to, as a continuation in part, to application Ser. No. 10/905,525 filed Jan. 7, 2005, now abandoned, entitled "Hydration Belt" which is incorporated by reference in its entirety. The present invention relates generally to a means for supplying hydrating liquid to a person, and particularly from a hydration belt for use during strenuous physical activity.

It is known in the prior art that heat and dehydration are the most serious threats to the health of runners and other athletes and even those engaged in strenuous manual labor such as digging ditches. A delicate balance of vital fluids is required for the body to function well. When the amount of water lost to the environment exceeds that taken in, the resulting body dysfunction can range from mild lethargy to cramps, exhaustion, and even death.

Hydration systems have been proposed in the prior art, for freeing runners during extended runs from dehydration worries, comprising belts designed to be worn about the waist or arm, belts which, in one form, comprise water belts that are self contained, that is, which directly contain water or other liquid, and which, in another form, are provided with a pocket or pockets for holding cans or bottles of liquid.

Hydration systems are utilized for the purpose of enabling runners to quench their thirst without having to plan their running routes around drinking fountains or stashing containers of liquid around the route, thus providing new freedom, particularly in long training by allowing runners to choose routes with questionable water sources.

A disadvantage with the prior art hydration systems is the difficulty in getting liquid from the belt to the runner's mouth. The known hydration systems require drinking only from a drinking tube, which can be inconvenient, especially when the strenuous activity is over, and the user is interested in casually and easily drinking his liquid.

Accordingly there is a need for a hydration belt that overcomes these and other disadvantages.

SUMMARY OF THE INVENTION

The present invention relates generally to hydration devices.

According to one aspect of the present invention, a wearable hydration belt is provided comprising: a belt; at least one flexible liquid container coupled to the belt, wherein the at least one flexible liquid container is substantially flat and belt shaped, the at least one flexible liquid container being more than half the length of the wearable hydration belt; a port located on the liquid container; an extendible drinking tube configured to couple to the port at one end and a pumping mechanism in communication with a second end of the extendible drinking tube to pump water from liquid contained in the flexible liquid container through the port and the extendible drinking tube.

According to another aspect of the present invention, a wearable hydration belt is provided comprising: a belt; a first flexible liquid container coupled to the belt, wherein at least one flexible liquid container is substantially flat and belt shaped, the at least one flexible liquid container being more than half the length of the wearable hydration belt; a port located on the liquid container; an extendible drinking tube configured to couple to the port at one end and a spout in communication with a second end of the extendible drinking tube to allow liquid contained in the flexible liquid container to flow through the port, the extendible drinking tube and the spout.

According to another aspect of the present invention, a wearable hydration belt is provided comprising: a belt configured to attach to a person's wrist; at least one flexible liquid container coupled to the belt; and a port located on the liquid container, the port configured to release liquid upon application of a negative pressure.

These and other features, aspects and advantages of the present invention will become better understood with reference to the following description and claims.

BRIEF DESCRIPTION OF THE DRAWINGS

The present disclosure will be better understood by those skilled in the pertinent art by referencing the accompanying drawings, where like elements are numbered alike in the several figures.

FIGS. 1-27 depict the present invention.

DETAILED DESCRIPTION

Figure 1:
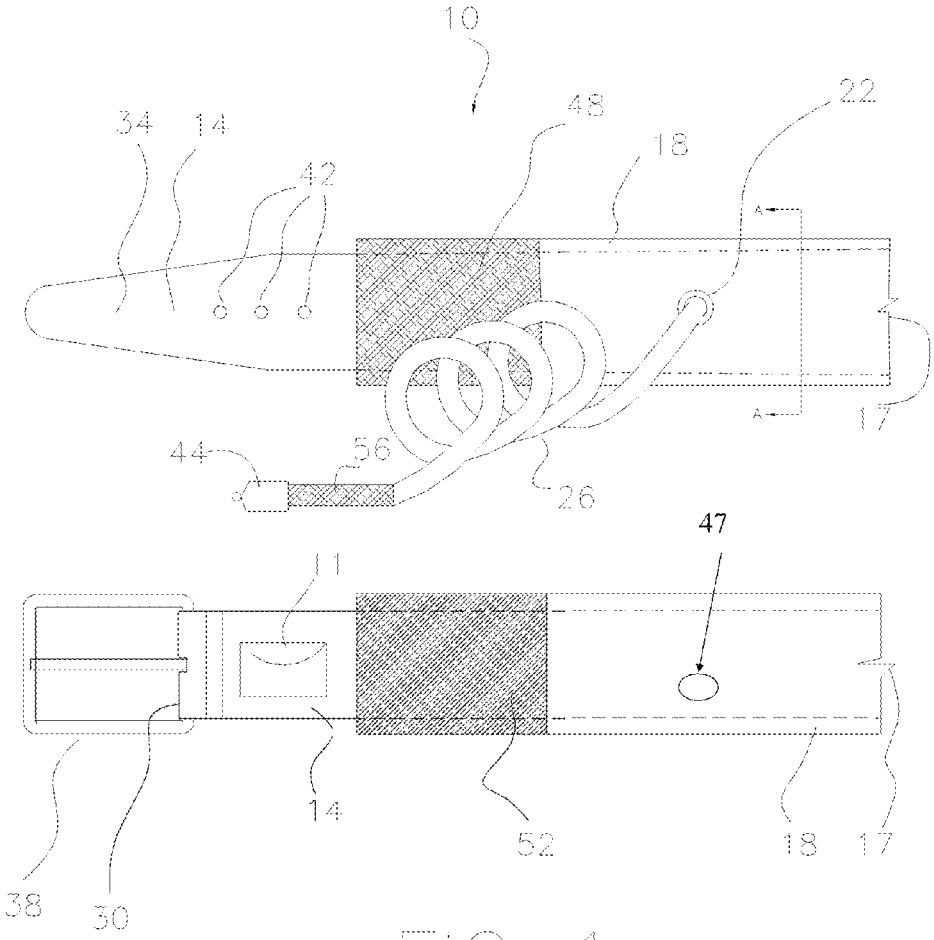

FIG. 1 is a top view of one embodiment of the hydration belt 10. A belt 14 that is wearable about or near a person's waist is shown with a container 18 attached to the belt 14. A port 22 is located on the container 18. The port is connectable to an extendible tube 26. A single hydration belt 10 is shown in FIG. 1, the upper and lower segments of belt 14 are connected beyond the break 17 in the figure, and similarly the upper and lower segments of container 18 are also attached beyond the breaks 17 in the figure. The belt 14 has a first end 30, and a second end 34. The first end 30 may have a buckle 38. The second end 34 may have holes 42 configured to receive the belt buckle 38. Of course, one of ordinary skill in the art will recognize that any of a number of connecting systems may be used to connect the first end 30 to the second end 34, including, but not limited to: strap connectors, military style web belt buckle, strap buckle, Velcro, snaps, buttons and hooks. The hydration belt may be configured to couple via coupling means 11 to a portable CD player, radio tuner, or any other portable device that can provide sounds to the user. The coupling means may include, but is not limited to a pocket rap(s), and Velcro.

Figure 9:
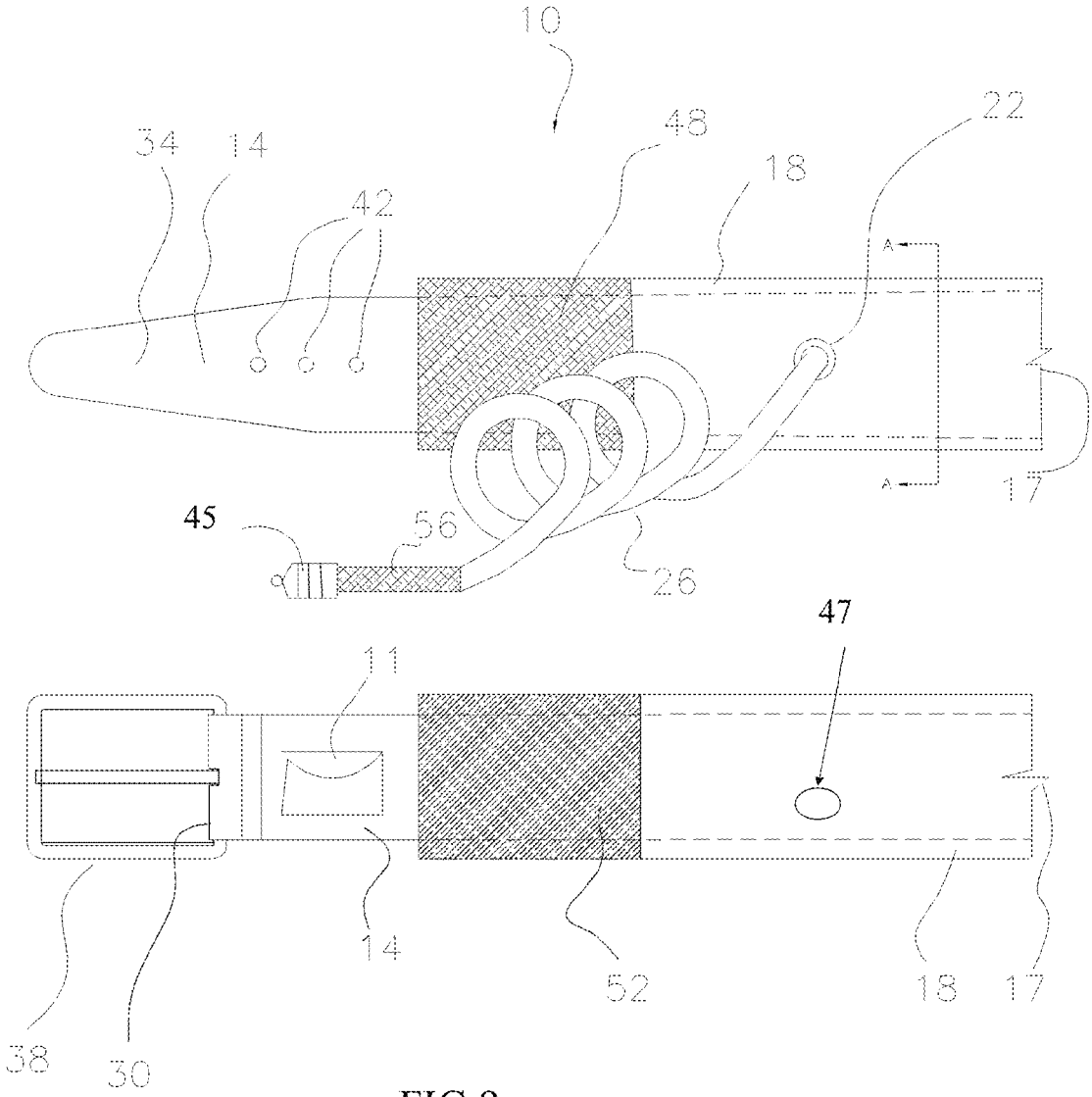
Figure 24:
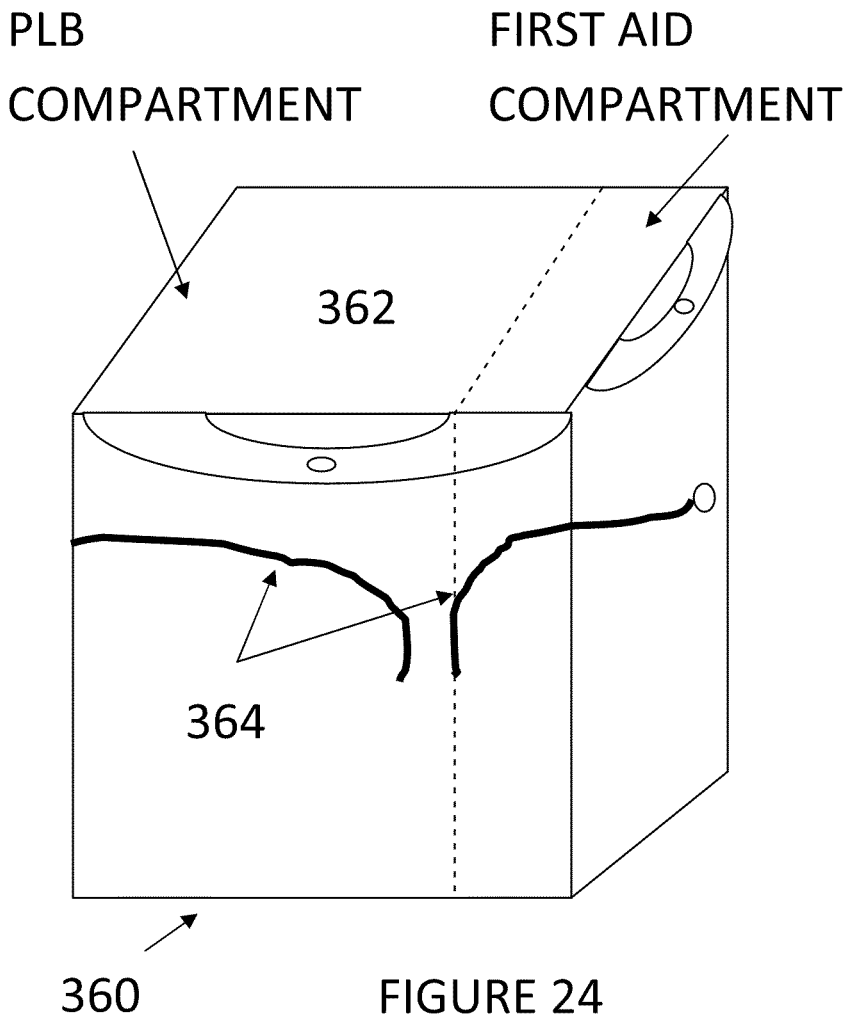
Figure 26:
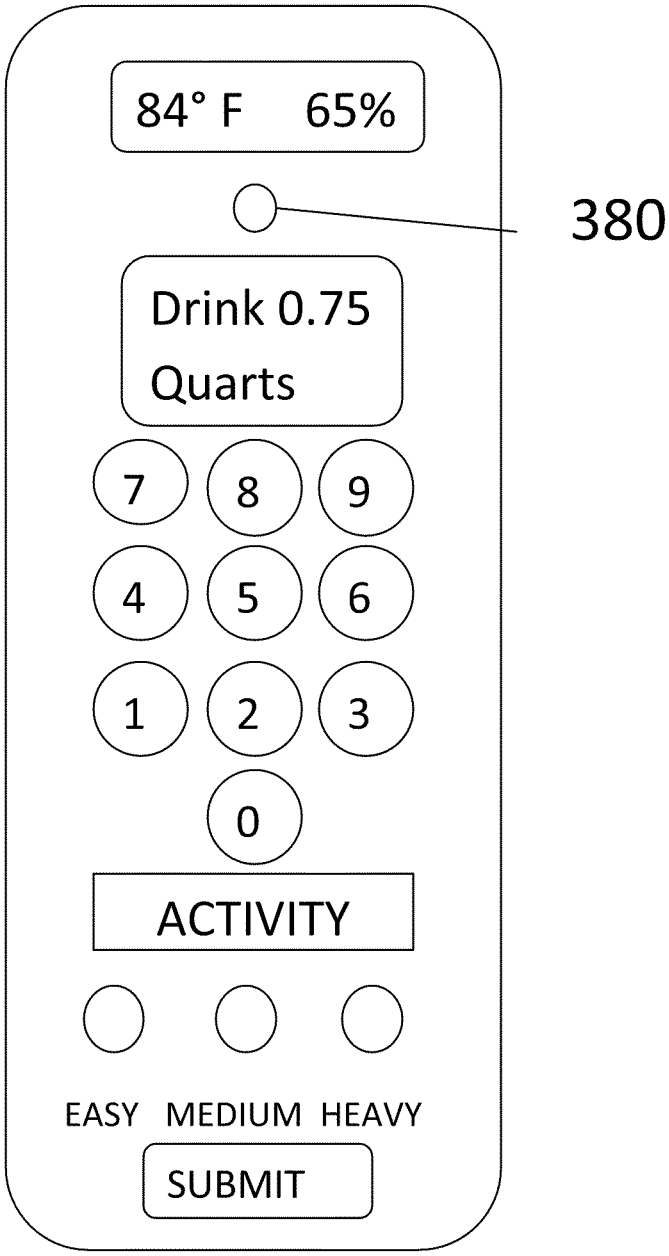

The extendible tube 26 may be a coiled tube as shown in FIG. 1, or may be made from a water proof material that allows the tube 26 to extend to about 3 feet and return to its original length. Such materials may include, but are not limited to: rubber, nylon, memory alloy, plastic, and spandex. The tube 26 is detachably coupled to the container 18 via the port 22 on the container 18. On the other end of the tube 26, there is a spout 44 coupled to the tube 26. The spout 44 has a valve that allows liquid from the container 18 to flow out of the tube only when engaged by a user. In another embodiment, as depicted in FIG. 9, the spout 44 may be replaced by a pumping mechanism 45 to allow a user to pump liquid out of the container 18. The pumping mechanism may be a spray type pump, as used for spray bottles. The hydration belt 10 may also have Velcro surfaces 48, 52 attached to the belt 14. The Velcro surfaces may be configured to attach to a Velcro surface 56 located near one end of the tube 26, to hold the tube against the belt 14 while the user is engaged in some activity, such as, but not limited to: running, exercising, bicycling, and hiking. There may also be a locator beacon 47. Locator beacons may, for example, emit a 25-100 milliwatt 121.5 406 MHz ELT or EPIRB analog homing signal. Locator beacons are useful for hikers, backpackers, horsemen, climbers, rafters, kayakers, sailors, hunters, pilots and others who may find themselves lost, stranded, injured or in need of rescue. Typically locator beacons must be registered with NOAA (National Oceanic and Atmospheric Administration) which maintains the database for emergency beacons in the U.S. Each PLB has a unique digital code, so search and rescue will be able to immediately know who owns the beacon. As shown in FIG. 24, the Hydration belt may have a pouch (360), which may be cylindrical or rectangular in shaped) firmly attached in the vertical position to the right hand side of the front portion of the belt. The pouch will contain the wearer's Personal Locator Beacon (PLB). This pouch will have a rubberized interior to prevent any liquid infiltration into the pouch. The pouch will have an opening at the top with a flap (362) extending over the zippered portion to protect it under all weather conditions. Pouch is sized to contain the largest PLB on the market at that time. Should a smaller size PLB be placed in the pouch, draw strings (364) located at the center of the pouch can be pulled and tied to prevent movement of the smaller PLB inside the pouch. There may also be a hydration timer and alarm. Wearers such as hikers, cyclists, backpackers and hunters have been known to dehydrate under extreme weather conditions. Dehydration is a gradual process and is not always perceived in time. Under extreme conditions it could result in death to the wearer. For this reason it is advisable to wear a hydration timer and alarm device (as depicted in FIG. 26) which will alert a wearer exposed to extreme weather conditions of the need to hydrate on a regular basis while exposed to those conditions. The hydration timer and alarm may be attached to the left hand side of the front portion of the belt. At the start of the physical activity, the wearer will press a "Start" or "on/off" button (380). An electronic temperature measuring device will measure the amount of time a wearer is exposed to high ambient temperature conditions. It is a cumulative measuring device using units of degree-hours. The higher the ambient temperature, the shorter the time period between hydration alarms. As an example, the alarm could be set to go off at 100 degree-hours, meaning that the wearer has been exposed to 100 degrees F for one hour. If the ambient temperature was 80 degrees, that alarm would sound after 1.25 hours. The same measuring device measures the amount of time a wearer is exposed to low ambient temperature conditions. At a pre-set point of degree-hours, the alarm will go off.

Figure 2:
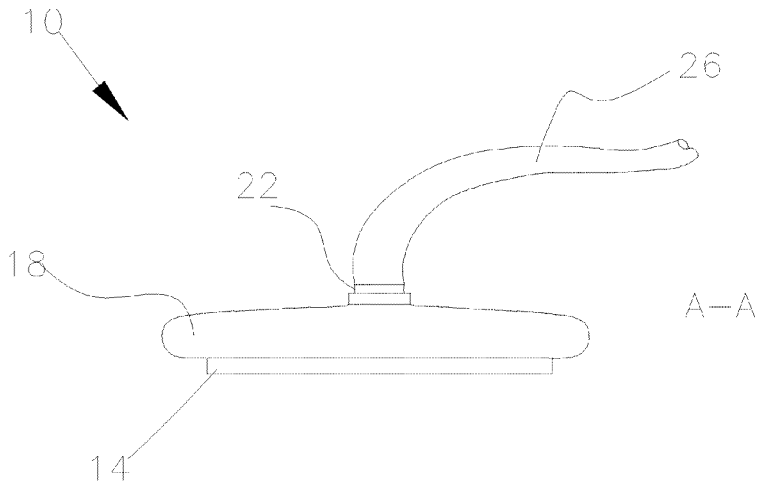

FIG. 2 shows a cross-sectional view of the hydration belt 10 from FIG. 1. The container 18 can be filled with liquid by removing the tube 26 and adding liquid into the port 22. The container 18 may be made from any flexible material, including but not limited to: rubber, plastic, nylon, memory alloy. The container should also have insulating properties, to keep the liquid cold, or warm. The container may be transparent, translucent, or opaque. The belt 14 may be available in various sizes, such as, but not limited to small, medium, large, extra large, and extra extra large. Portions of or the entire belt 10 may be coated with a reflective or luminescent material to provide visibility when wearing the belt 10 during low or no light conditions.

The hydration belt 10 may be configured to be used to provide nourishment for a baby. In one embodiment, the hydration belt 10 may be substituted for a baby's bottle. The tube 26 may have a nipple coupled to one end to allow a baby to obtain liquid from the container 18. In this embodiment, the hydration belt 10 may be sold to the consumer in a sterilized condition, and configured such that there will be no parts small enough to cause a choking hazard to a baby. This embodiment may also be configured to be disposable after one or more uses.

In another embodiment, the hydration belt 10 may be configured for military use. The container 18 may have a plurality of Velcro surfaces configured to couple to the belt 14. The belt 14 may be made from military webbing. This embodiment may replace the typical soldier's canteen.

Figure 3:
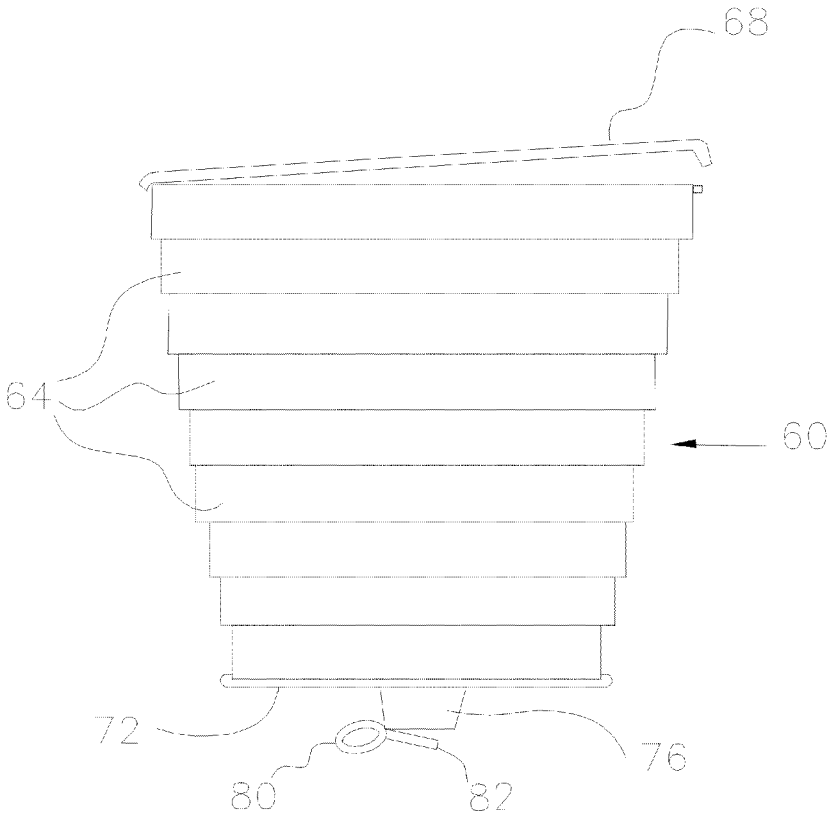

FIG. 3 shows another aspect of the disclosed embodiment. The hydration belt 10 from FIG. 1 may be configured to have a compressible coiled cup 60 attachable to it. The cup 60 may be composed of interlocking cylindrical segments 64 that can be expanded to form a generally conical shape when in an expanded mode. The generally conical shape of the cup will include a generally frusto-conical shape. When in an expanded mode, the cup 60 may be filled with liquid from the container 18 and thereafter be drunk from, or poured over one's head, or allow another person easy access to the liquid in the container by lending the filled cup to the person. The cup 60 has a lid 68 that can be removed to allow liquid from the container 18 to be placed into the cup 60. The lid 68 may be hinged or unhinged. The bottom surface 72 of the cup 60 has a port 76. The port 76 may be attached to a pull ring 80. Although a pull ring 80 is shown, any device that will allow one to pull the port 76 so that it protrudes out of the cup 60 will suffice; other devices may include a pull tab, or the like. The port 76 has a port lid 82. When the port lid 82 is opened, the tube 26 may be attached to the port 76, and the cup may act as a funnel to allow liquid to be put into the container 18. The pull ring 80 may be configured to allow the user to open the port lid 82.

Figure 4:
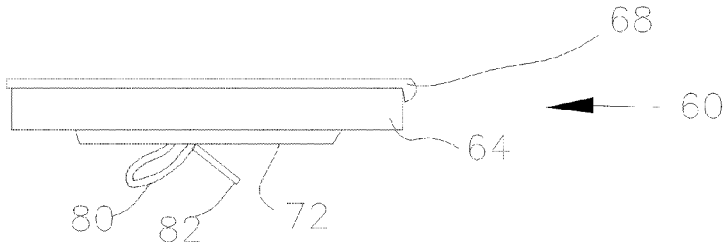

FIG. 4 shows the compressible coiled cup 60 in a compressed state. The interlocking cylindrical segments have slid across each other in order to collapse the cup to the relatively flat shape shown in FIG. 4. The port 76 is slideably attached to the bottom surface 72, and is slid up into the interior of the collapsed volume of the cup. The port lid 82 is shown opened, and the lid 68 is shown closed. The cup 60 may be attached to the hydration belt 10 in any number of ways known in the art, including, but not limited to: a pocket, Velcro, snap, buttons, and hooks. The coiled cup 60 may be made from any appropriate material including but not limited to: stainless steel, plastic, rubber, and nylon.

Figure 5:
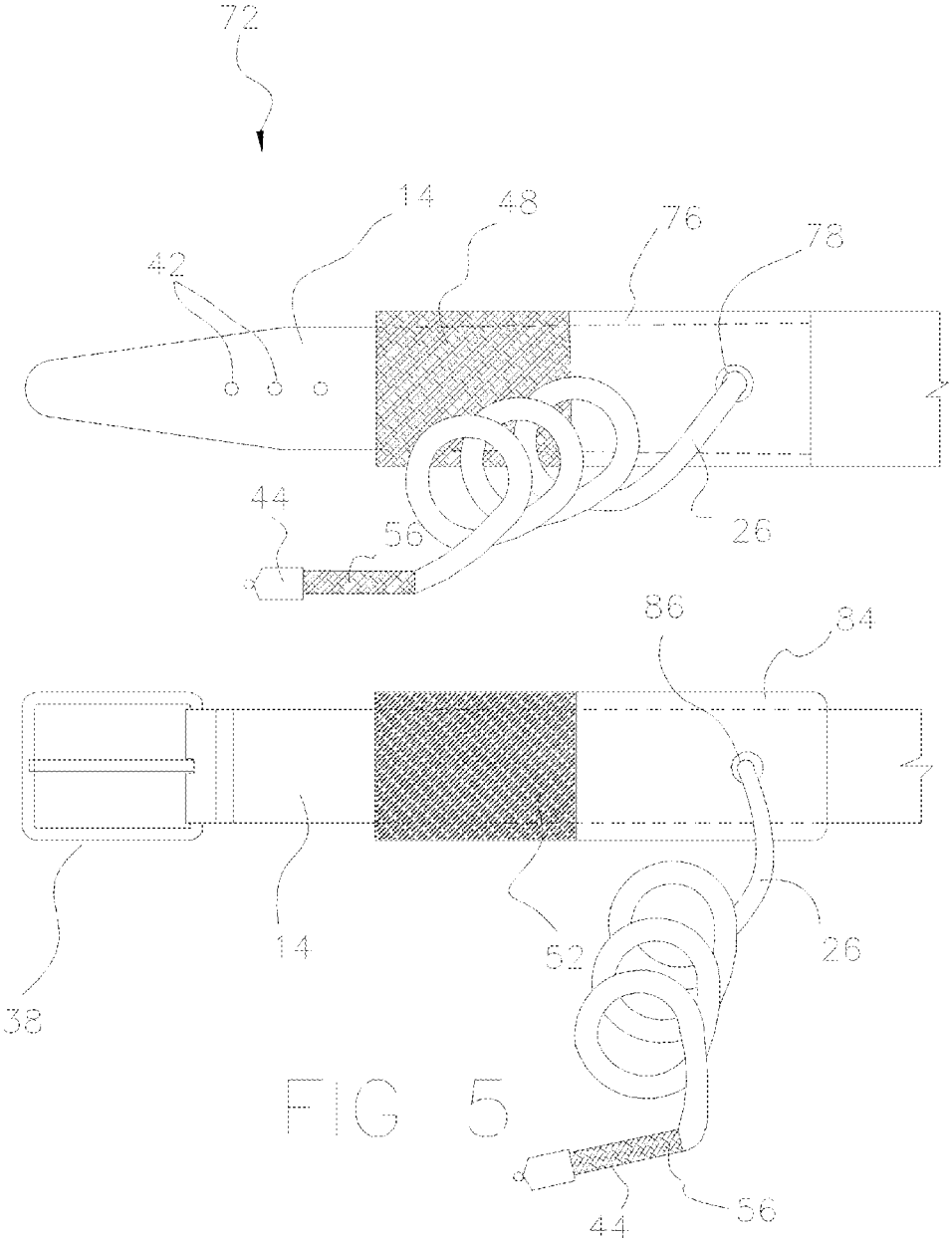

FIG. 5 shows another embodiment of the disclosed hydration belt 72. In this embodiment, the belt 14 is coupled to a plurality of liquid containers 76, 84. In the embodiment shown, two containers 76, 84, are shown coupled to the belt, however, more containers may be coupled to the belt 14 in other embodiments. Each container 76, 84 has a port 78, 86. The ports 78, 86 are configured to couple to a drinking tube 26. The embodiment shown in FIG. 5, shows each port 78, 86 coupled to a drinking tube 26. However, in other embodiments, only one tube may be coupled to one of the two or more ports 78, 86, and when the liquid in the associated container is depleted, the user may disconnect the tube 26 from one port, and attach it to another port. Thus, it should be clear that the ports in this embodiment may have a cap or a valve which prevents liquid from escaping the containers 76, 84 when the tube 26 is not coupled to the ports 78, 86. In another embodiment, a valve may be coupled to containers 76 and 84. The valve may be user operated to allow the user to switch from container 76 to container 84, and vice versa. Such a valve may be useful for any user who desires the hydration belt 72 to easily and quickly switch between container 76 and container 84, without the need for 2 drinking tubes 26. This embodiment may be useful for the recreational user, or for the user competing in a road race.

The hydration belts 10, 72 may be configured to feed a baby or toddler. The drinking tube 26 may be fitted with a baby's nipple, and the container 18 filled with a liquid suitable for a baby or toddler to drink.

Additionally, the hydration belts 10, 72 may be coupled to a power source to supply power for a various purposes, such as to power an electric pump fitted onto the drinking tube 26 or container 18, or to power a heater for the liquid container 18, or to power a chiller for the liquid container 18.

FIG. 6 shows a top view of another embodiment of the disclosed hydration belt 90. In this embodiment, the belt 94 is configured to fit around a user's wrist or forearm. The belt is coupled to a container 98. The container has a port 102. The port 102 may have a valve that allows a user to apply negative pressure to the port with his or her mouth in order to send water from the port to his or her mouth. The belt 94 may be affixed with Velcro surfaces 106, 110 which allows for coupling a first end 114 of the belt 94 to a second end 118 of the belt 94. However, other methods of attaching the first end 114 to the second end 118 may be employed, such methods include, but are not limited to, the use of hooks, buttons, snaps, and buckles. In another embodiment, a time keeping device (timepiece) 95 may be attached to the belt 94. FIG. 7 shows a cross-sectional view of the hydration belt 90 from FIG. 6.

Figure 8:
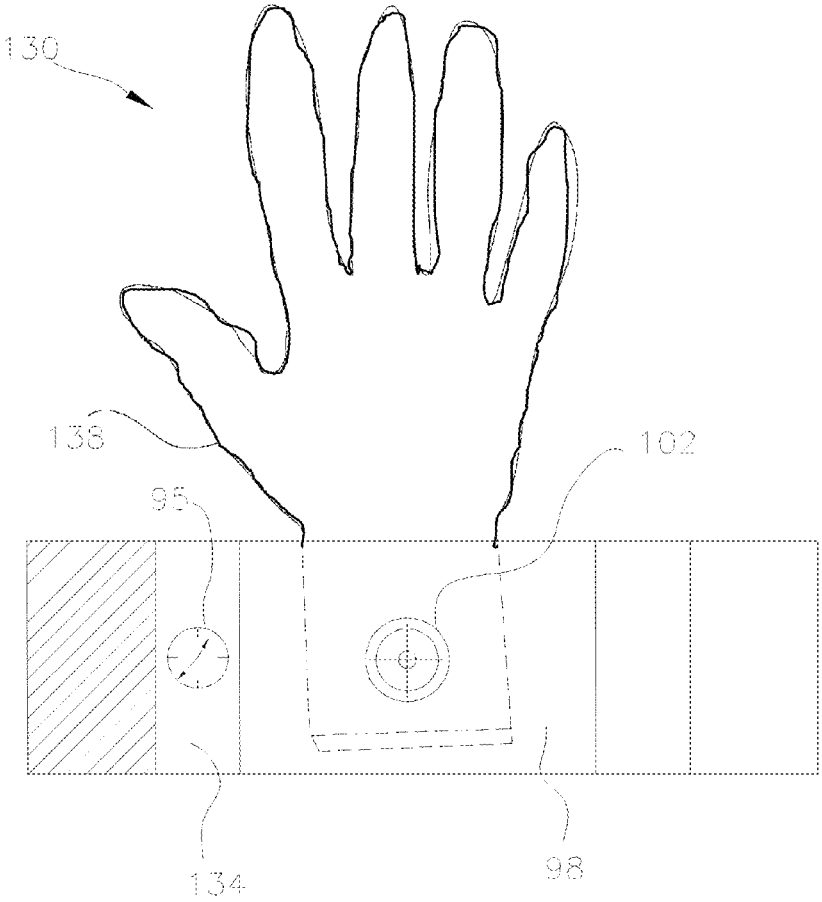

FIG. 8 shows another embodiment of the hydration belt 130. In this embodiment, a belt 134 configured to fit around a user's wrist or forearm, is coupled to a glove 138. The glove 138 should be of a type to keep the wearer's hand warm during cold weather. Also attached to the belt 134 is a container 98 for liquid with a port 102. Portions of or the entire belt 130 may be coated with a reflective or luminescent material to provide visibility when wearing the belt 130 during low or no light conditions. This reflective or luminescent material will allow nighttime users to signal traffic that a right or left turn is imminent by using hand signals. Such users may include, but are not limited to runners, bicyclists, and traffic police officers.

The disclosed hydration belt provides a means of hydrating users engaged in strenuous activity, or working in very hot environments, such as, but not limited to runners and hikers. The hydration belt may also be used for spectators watching sporting events, in outdoor or indoor venues. Additionally the disclosed hydration belt may be used to provide liquid to babies. The drinking tube is extendible, thereby providing an easy way of getting the liquid from a container to the user's mouth. Additionally, the collapsible cup 60, see FIG. 3, provides a means of allowing a user to drink from a cup, instead of being forced to only drink from the tube 26. The cup 60 may also be used as a funneling device to refill the container 18 with liquid.

It should also be noted that the terms "first", "second", "third", "upper", and "lower" and the like may be used herein to modify elements performing similar and/or analogous functions. These modifiers do not imply a spatial, sequential, or hierarchical order to the modified elements unless specifically stated.

Figure 10:
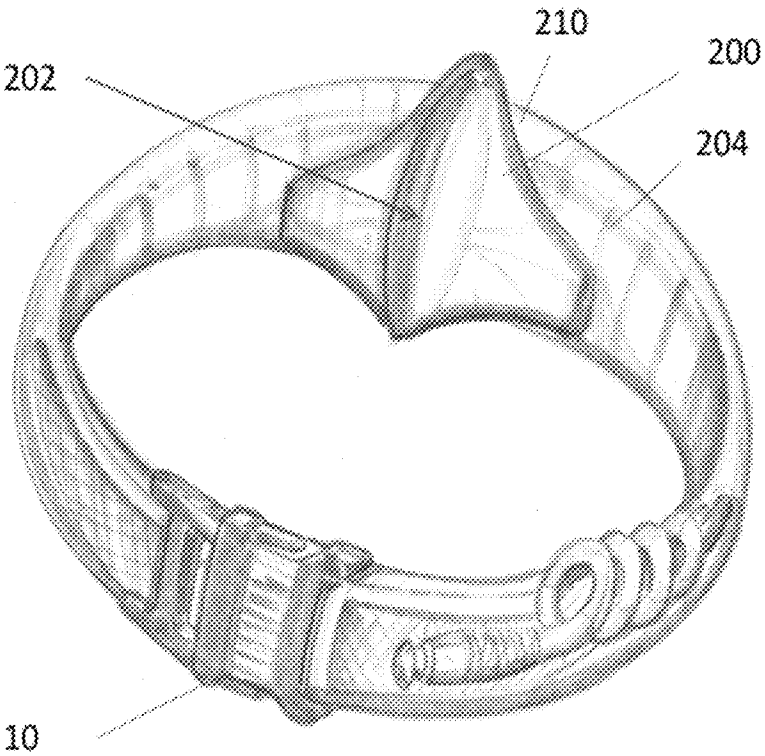
Figure 11:
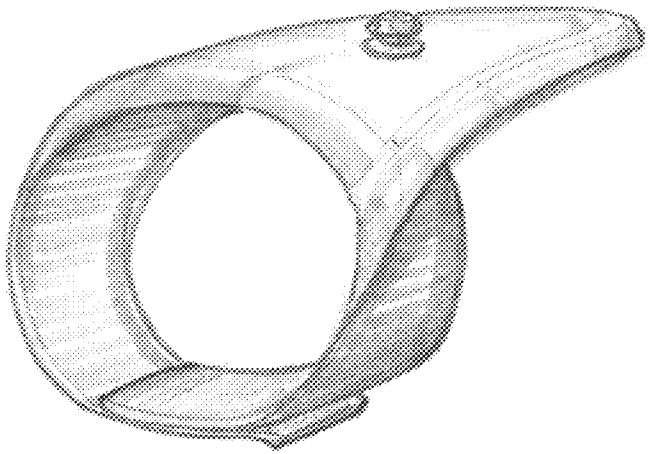
Figure 13:
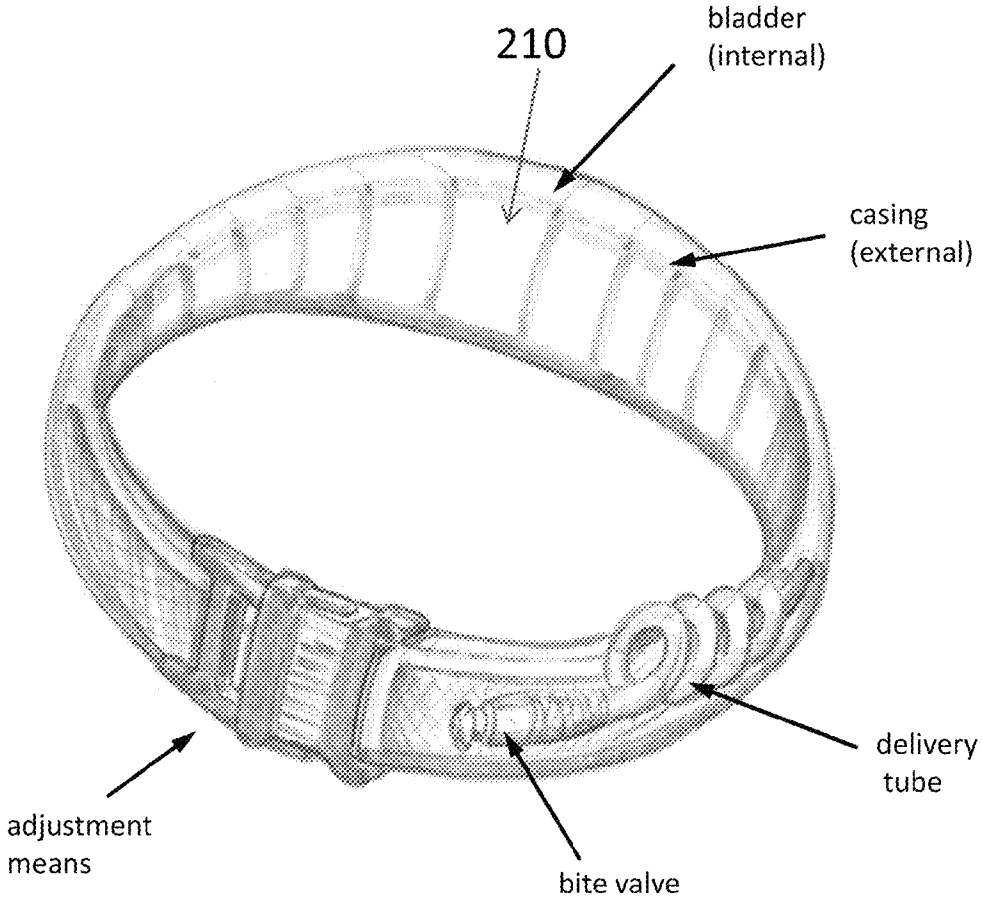

With reference to FIG. 10, at least one additional liquid container (200) is coupled to the belt (10). FIG. 10 provides one embodiment of an at least one additional liquid container (200) is an ergonomically designed back support attached to the back portion of the belt. The back support consists of two light weight vertical slabs made of semi-rigid plastic. These slabs will come in sizes that are related to small, medium, large and extra large tee shirt sizes. The slabs will be connected to each other by two diagonal cross bars consisting of the same semi-rigid plastic in order to limit any relative movement of the slabs with each other. The inside portion of the slabs that are in contact with the back have a soft compressible rubber lining to insure a comfortable fit. At the top of each slab is a hook to allow for the attachment of a back pack. Should a back pack be attached, the slabs will redistribute the pack load more evenly over the surface of the lower back and will insulate the wearer from the rubbing motion due to any swaying of the pack that might occur. The at least one additional liquid container (200) may be back support and at least one additional liquid container shaped to provide back and/or lumbar support. The middle portion (202) may also be a rounded oval shape that sits in the small of the wearers back, as depicted in FIG. 10. The at least one additional liquid container at least one additional liquid container back support (200) may be positioned in the middle portion (202) of the belt (10) and may increase in size towards the middle back portion. This at least one additional liquid container may increase towards the middle portion (202) (as in depicted in FIG. 10, 202). The at least one additional liquid container back support (200) may be removably coupled to the first liquid container (204). Examples of liquid connection means are depicted, without limitation, in FIGS. 14-23. This may be by any liquid connection means, as would be appreciated by those of skill in the art. By way of example, a liquid connection means may be fluid tight corresponding male (300) and female (302) connectors, wherein a male connector (300) is attached to at least one additional liquid container and a female connector (302) attached to a first liquid container to allow water to flow from the at least one additional liquid container to the first liquid container through the mated male and female connector. It should be understood the female connector (302) may also be attached to the at least one additional liquid container and a male connector (300) attached to the first liquid container without departing from the scope of the invention. It is envisioned that the at least one additional liquid container back support (200) may be disposable and may be prefilled with liquid. Alternatively, as depicted in FIG. 13, there may only be a single flexible liquid container which is an ergonomic shape increasing in size towards a middle back portion (210). The single flexible liquid container may also gradually increase wards the middle portion. There may also be an insulating casing surrounding the belt portion for comfort and insulation.

Figure 12:
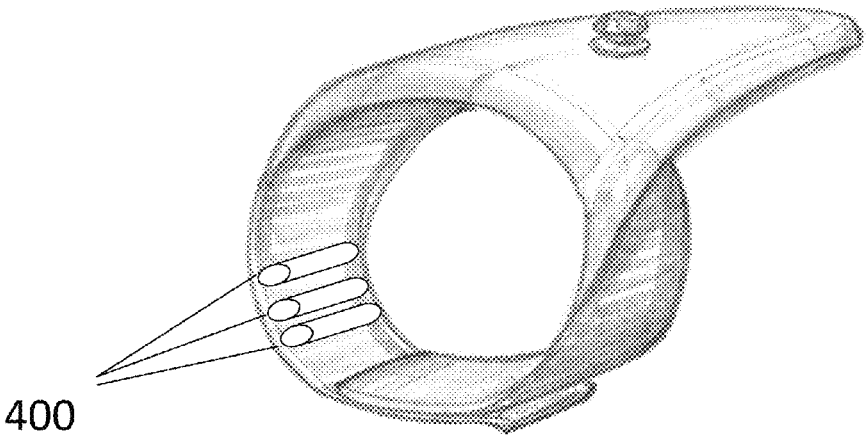
Figure 25:
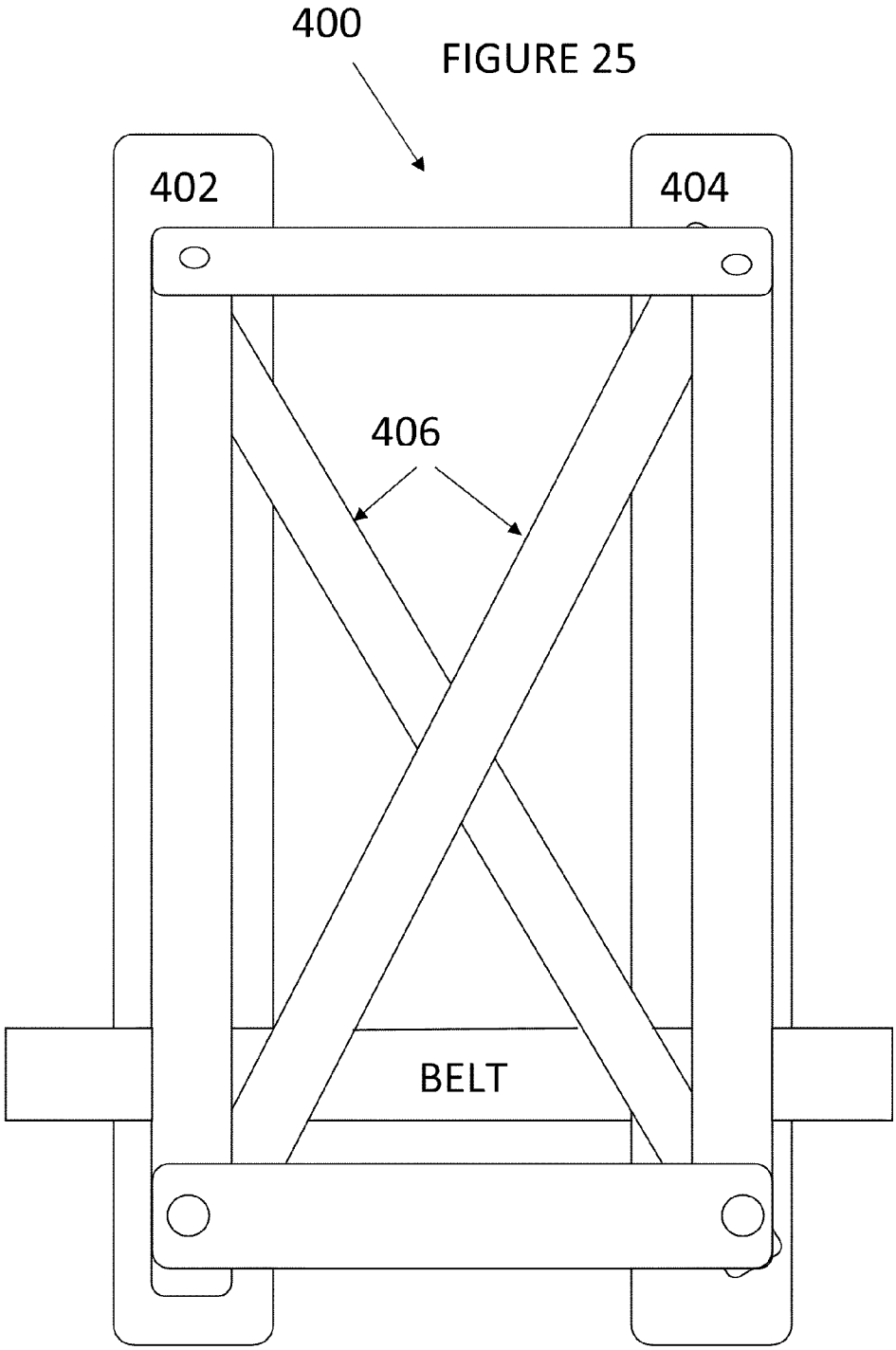
Figure 27:
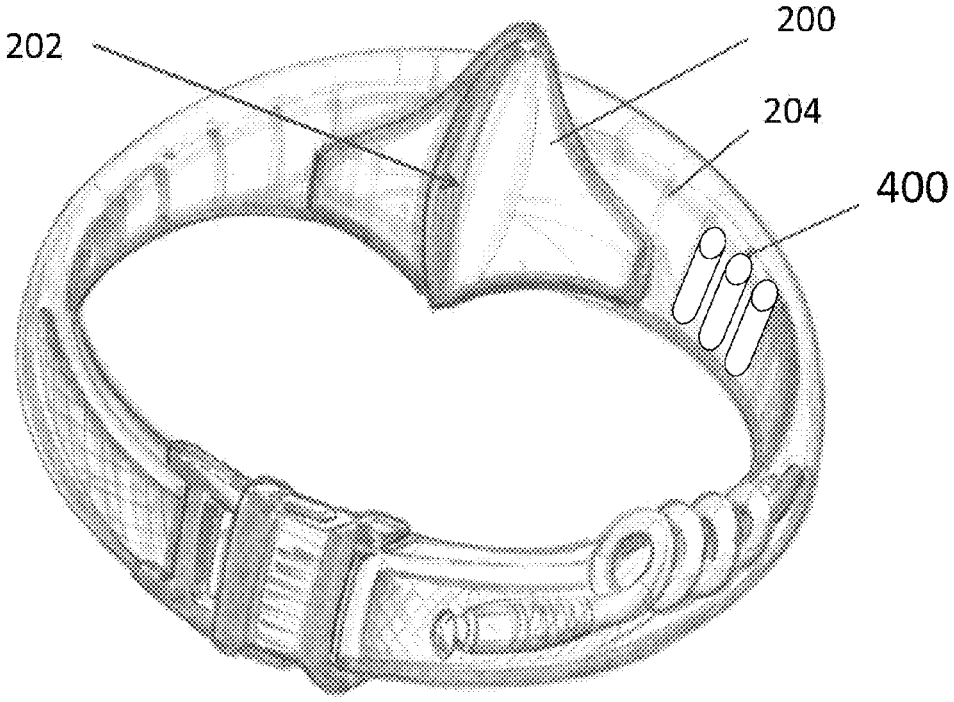

With reference to FIG. 25, an ergonomically designed back support (400) is attached to the back portion of the belt. The back support consists of two light weight vertical slabs (402, 404) made of semi-rigid plastic. These slabs will come in sizes that are related to small, medium, large and extra large tee shirt sizes. The slabs will be connected to each other by two diagonal cross bars (406) consisting of the same semi-rigid plastic in order to limit any relative movement of the slabs with each other. The inside portion of the slabs that are in contact with the back have a soft compressible rubber lining to insure a comfortable fit. At the top of each slab is a hook to allow for the attachment of a back pack. Should a back pack be attached, the slabs will redistribute the pack load more evenly over the surface of the lower back and will insulate the wearer from the rubbing motion due to any swaying of the pack that might occur. As shown in FIG. 27 and FIG. 12, the back support may also be at least one additional liquid container shaped to provide back and/or lumbar support. According to the embodiment shown, cylinders (400) are the additional liquid containers shaped to provide back and/or lumbar support.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments failing within the scope of the appended claims.

I claim:

1. A wearable hydration belt comprising:

a belt;

a first flexible liquid container coupled to the belt, wherein a first said at least one flexible liquid container is substantially flat and belt shaped, said first at least one flexible liquid container being more than half the length of said wearable hydration belt;

a second additional liquid container removably coupled and in liquid connection to the first flexible liquid container on inside of the middle portion of the belt, said second additional liquid container having a rounded oval shape portion that sits in the small of the wearers back when worn;

a port located on the first flexible liquid container;

an extendible drinking tube configured to couple to said port at one end and a pumping mechanism in communication with a second end of said extendible drinking tube to pump water from liquid contained in said flexible liquid container through said port and said extendible drinking tube; wherein said liquid connection is provided by a male connector on one of said liquid containers and a mating female connector on the other of said liquid containers to allow liquid to flow from said second additional liquid container into said first flexible liquid container.

2. A wearable hydration belt as in claim 1, wherein said pumping mechanism is a spray type mechanism.

3. The hydration belt of claim 1, wherein at least one additional liquid container is removably coupled to said first liquid container.

4. The hydration belt of claim 3, wherein said at least one additional liquid container is removably coupled to said first liquid container by a liquid connection means.

5. The hydration belt of claim 1, wherein said flexible liquid container is an ergonomic shape increasing in size towards a middle back portion.

6. The hydration belt of claim 1, further comprising at least one of a timepiece, compass, locator beacon, hydration timer and alarm, reflective material coupled to the belt and a nipple coupled to the drinking tube.

7. The hydration belt of claim 1, wherein said second additional liquid container has a first wide portion with flat side edges, a second narrowing portion that extends upward from the first wide portion and terminates in a first point, and a third narrowing portion that extends downward from the first wide portion and terminates in a second point, wherein a portion between the first point and the second point includes said rounded oval shape.

8. The hydration belt of claim 1, wherein a compressible coiled cup is removeably coupled to the belt, said compressible coiled cup having an top open end and a bottom end, said bottom end having an opening for receipt of liquid from said flexible liquid container into said compressible coiled cup.

9. The hydration belt of claim 8, wherein the compressible coiled cup is configured to expand to a generally conical shape in order to hold a liquid.

10. The hydration belt of claim 8, wherein the compressible coiled cup is configured to act as a funnel to refill the liquid container.

* * * * *